United States Patent [19]

Nakahata et al.

[11] 4,268,161

[45] May 19, 1981

[54] ELECTROPHOTOGRAPHIC APPARATUS WITH CORONA DISCHARGE CONTROL

[75] Inventors: Kimio Nakahata, Kawasaki; Yoshinori Aguro, Fuchu; Yasuyuki Tamura, Kawasaki, all of Japan

[73] Assignee: Canon Kabushiki Kaisha, Tokyo, Japan

[21] Appl. No.: 81,850

[22] Filed: Oct. 4, 1979

Related U.S. Application Data

[63] Continuation of Ser. No. 872,779, Jan. 27, 1978, abandoned.

[30] Foreign Application Priority Data

Feb. 9, 1977 [JP] Japan ..... 52-13388

[51] Int. Cl.[3] ..... G03G 15/02

[52] U.S. Cl. ..... 355/3 CH; 307/24; 361/235

[58] Field of Search ..... 307/18, 24, 29, 100, 307/146; 323/6, 7, 50, 87, 88, 94 R; 355/3 CH, 14 CH; 361/230, 235

[56] References Cited

U.S. PATENT DOCUMENTS

| | | | |
|---|---|---|---|
| 2,892,148 | 6/1959 | Large et al. | 323/88 X |
| 3,103,618 | 9/1963 | Slater | 307/146 X |
| 3,182,249 | 5/1965 | Pahlavan | 323/50 X |
| 3,188,554 | 6/1965 | Reid | 323/94 R |
| 3,568,042 | 3/1971 | Casa | 323/88 X |
| 3,714,531 | 1/1973 | Takahashi | 361/230 |
| 3,775,104 | 11/1973 | Matsumoto et al. | 355/3 CH |
| 4,045,217 | 8/1977 | Fujimura | 355/14 CHJ |
| 4,092,582 | 5/1978 | Newbould | 323/50 X |
| 4,136,942 | 1/1979 | Nakahata et al. | 355/14 CH |
| 4,142,791 | 3/1979 | Nishikawa et al. | 355/3 CH |

*Primary Examiner*—A. D. Pellinen

*Attorney, Agent, or Firm*—Fitzpatrick, Cella, Harper & Scinto

[57] ABSTRACT

An electrophotographic apparatus includes a photosensitive member with a conductive layer, a photoconductive layer and an insulating layer; a variably controlled primary corona discharger for applying a charge of a predetermined potential onto the surface of the photosensitive member, a secondary corona discharger for applying a corona discharge containing a component of which polarity is opposite to that of the primary corona discharge; an imagewise exposure device for exposing the photosensitive member to an image light substantially simultaneously with the corona discharge by the secondary corona discharger, and high voltage source, for supplying predetermined high voltages to the primary and secondary corona discharger, having a high voltage transformer provided at least with a primary input coil, a secondary high voltage output coil and a tertially coil associated with a variable load impedance. An electrostatic latent image of a predetermined contrast is formed on the photosensitive member.

10 Claims, 14 Drawing Figures

DROOPING CHARACTERISTIC

ELECTROPHOTOGRAPHIC APPARATUS WITH CORONA DISCHARGE CONTROL

This is a continuation of application Ser. No. 872,779, filed Jan. 27, 1978, now abandoned.

BACKGROUND OF THE INVENTION

1. Field of the Invention

The present invention relates to an improved electrophotographic apparatus, and particularly to an electrophotographic apparatus utilizing a photosensitive member essentially composed of an electroconductive layer, a photoconductive layer and an insulating layer, and capable of providing a satisfactory electrostatic latent image achieving a desired contrast level and still avoiding background fog at the image development.

2. Description of the Prior Art

In the prior art there are already known various apparatus capable, based on electrophotographic processes, of forming an image on a photosensitive member provided with a photoconductive element.

Particularly an electrostatic latent image of an elevated contrast is obtainable with an apparatus utilizing a photosensitive member essentially composed of an electroconductive layer, a photoconductive layer and an insulating layer for forming the electrostatic latent image through the steps of a primary electrostatic charging, an imagewise exposure, a simultaneous electrostatic charging of inverted polarity or AC static elimination, and if necessary a whole surface exposure according for example to the electrophotographic processes disclosed in the U.S. Pat. No. 3,666,363 or 3,734,609, and such apparatus have been identified as extremely useful for practical purposes.

In the prior electrophotographic apparatus, the use of magnetic brush developing device has been quite common for the development of electrostatic latent image formed on the photosensitive member because of compact structure and easy maintenance of such device. However, the indiscriminative contact of the toner particles with both the image or dark area and the non-image or light area, as observed in the above-mentioned magnetic brush development, tends to result in a development of non-image area, or, so-called toner fog.

For example in the magnetic brush development, the potential in the non-image area is preferably maintained within a range from −50 to −100 V since a more positive potential will result in the above-mentioned toner fog while a more negative potential will also lead to an another drawback of carrier deposition. In any development method, therefore, it is essential, for achieving a satisfactory image quality, to maintain a suitable potential in the non-image or background area on the photosensitive member which generally corresponds to the light or background area of the original image.

Also in practical electrophotographic apparatus, the field maintenance is often carried out in such a manner to elevate the potential of electrostatic charging in order to compensate the reduced dark resistance resulting from certain deterioration of the photosensitive member after repeated use thereof or the deficient concentration of developer thereby sustaining the image quality.

In case of an apparatus based on the electrophotographic process as mentioned in the foregoing, such maintenance operation is conducted by modifying the potential of the primary electrostatic charging.

This is based on a fact that the surface potential V of the photosensitive member provided with an insulating layer is correlated with the amount of discharge Q resulting from thus modified primary charging by the following equation:

$$\text{Amount of discharged electrostatic charge } Q \propto \text{Surface potential } V$$

It will be noted, however, that such increase in the amount of discharge in the primary charging will not only elevate the potential of dark area on the photosensitive member corresponding to the dark area of the original light image but also result in an increased potential in the background area thereof, and thus obtained electrostatic latent image with increased background potential tends to show fog formation at the development thereof.

In order to eliminate such fog formation it is necessary to obtain an appropriate background potential by regulating the intensity of the secondary AC corona static elimination. Thus the adjustment of the primary charging potential also necessitates the adjustment of intensity of the AC corona static elimination. Although the surface potential control by the AC corona discharge has been achieved by adding a bias voltage to a sinusoidal AC voltage, such method generally requires an elevated voltage in order to maintain the background potential at −50 to −100 V in an electrophotographic apparatus and is inevitably dangerous particularly when the apparatus is made smaller. Such method of control by adding a bias voltage to a sinusoidal AC voltage is specifically disclosed for example in the U.S. Pat. No. 3,714,531, particularly in FIG. 4 and column 3, lines 43 to 51 thereof.

Also as an another means of control there is proposed a method of causing a distortion in the sinusoidal AC output current. Such distortion can be achieved by connecting a variable impedance in parallel with the AC corona static eliminator to the output of a power supply and thereby suitably controlling the positive and negative sides of the corona discharge current, but the voltage-current characteristics of the transformer inevitably generate a voltage as high as several kilovolts applied to the regulating variable impedance. Due to the presence of such high voltage, this method can also be similarly dangerous as the foregoing one unless suitable measures are taken for safety. The specific structure of such regulating element between the discharge wire and the high-voltage power supply is disclosed for example in the specification of the above-cited patent, column 3, lines 9 to 34 and FIG. 3 thereof.

However the means based on these methods, even if incorporated in the conventional electrophotographic apparatus, often involves difficult adjustments and usually allows to obtain optimum background potential only after prolonged adjustment procedure.

The present invention has been reached in consideration of the above-explained state of the art.

SUMMARY OF THE INVENTION

An object of the present invention is to provide an electrophotographic apparatus allowing satisfactory image reproduction with an elevated contrast and without background fog.

An another object of the present invention is to provide an electrophotographic apparatus allowing to maintain satisfactory image reproduction and being provided with an adjusting mechanism of elevated safety.

A still another object of the present invention is to provide an electrophotographic apparatus allowing rapid adjustment of the potentials of dark area and background area in the electrostatic latent image to be formed on the photosensitive member.

The apparatus of the present invention is featured by a composition comprising a photosensitive member essentially composed of an electroconductive layer, a photoconductive layer and an insulating layer; a primary corona discharge means with a variable amount of corona discharge so as to provide a static charge of a determined potential onto the surface of said photosensitive member; a secondary corona discharge means for applying a corona discharge onto the surface of said photosensitive member, said corona discharge containing a component of a polarity opposite to that of said primary corona discharge; an imagewise exposure means for exposing said photosensitive member to a light image substantially simultaneously with the corona discharge of said secondary corona discharge means; and a high-voltage supply means for supplying determined high voltages to said primary and secondary corona discharge means, said means comprising a high-voltage transformer provided with at least an input primary coil, an output secondary coil and a tertiary coil including a variable impedance.

An another apparatus of the present invention is featured by a composition further comprising a corona discharge correlating means for controlling the amounts of corona discharges of said primary and secondary corona discharge means in combination.

Still another objects and compositions of the present invention will be rendered clear from the following description of the examples embodying the present invention.

DESCRIPTION OF THE PREFERRED EMBODIMENTS

Figure 1A:
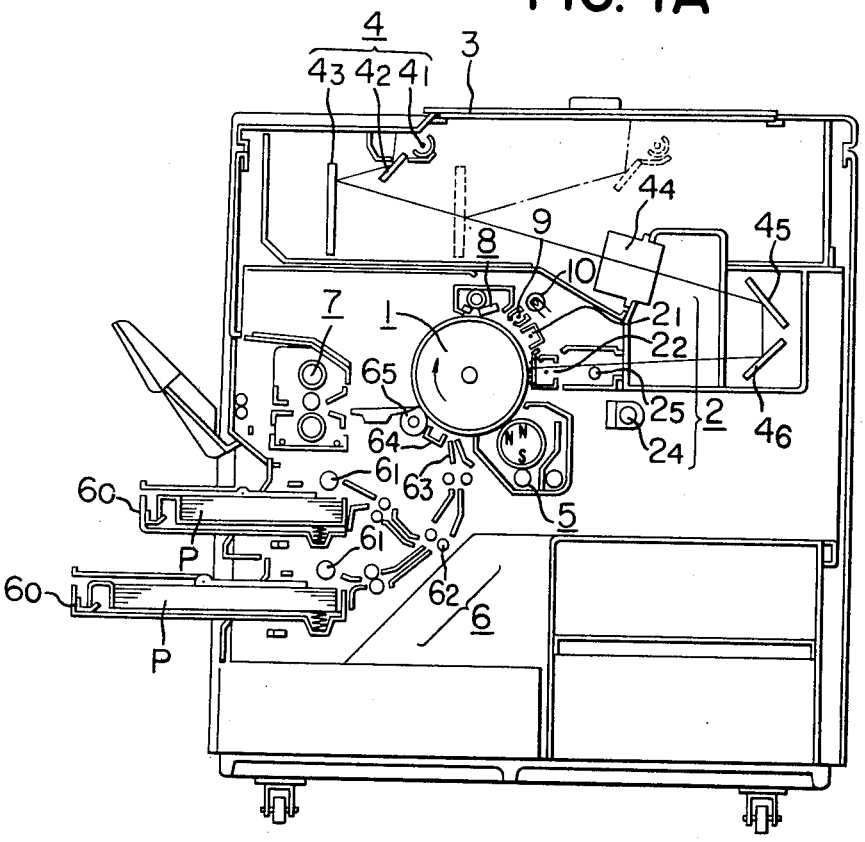
FIG. 1A is a lateral view of an electrophotographic apparatus embodying the present invention.
Figure 1B:
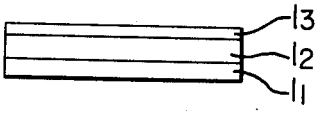
FIG. 1B is a cross-sectional view illustrating the structure of the photosensitive member.

Referring at first to FIGS. 1A and 1B respectively showing the lateral view of an electrophotographic apparatus embodying the present invention and the cross-sectional view of a photosensitive member to be employed therein, the photosensitive member is essentially composed of an electroconductive layer $\mathbf{1}_1$, a photoconductive layer $\mathbf{1}_2$ and an insulating layer $\mathbf{1}_3$, wherein said electroconductive layer being composed of aluminum, said photoconductive layer $\mathbf{1}_2$ being composed of a coated layer of photoconductive CdS activated with copper and dispersed in a resinous binder, and said insulating layer $\mathbf{1}_3$ being composed of a Mylar (tradename) film adhered onto said photoconductive layer by means of an adhesive.

The photosensitive member composed as mentioned above is structured and supported as/a rotatable drum and functions as a photosensitive drum 1.

Along the periphery of said photosensitive drum 1 there is provided at first an electrostatic latent image forming means 2 comprising a primary corona discharger $\mathbf{2}_1$ for applying a corona discharge of a determined polarity onto the surface of said photosensitive drum, a secondary corona discharger $\mathbf{2}_2$ capable of performing a corona discharge containing a component of a polarity opposite to that of said primary corona discharge thereby subjecting the surface of said photosensitive drum to an asymmetrical AC charging or static elimination of a polarity inverse to that of said primary corona discharge or of a prevailing component of such inverted polarity, said secondary discharger being further provided with a shield case optically open at the back side thereof, a control grid $\mathbf{2}_3$ provided in front of said secondary corona discharger for preventing uneven charging thereof, a flash exposure source $\mathbf{2}_4$ consisting for example of a tungsten lamp or a fluorescent lamp, and a blank exposure light source $\mathbf{2}_5$ consisting for example of a tungsten lamp for irradiating the surface of said photosensitive drum when it is not exposed to the original light image.

Said corona discharger is connected to a high-voltage power supply which will be explained later.

An original image of which latent image is to be formed in said latent image forming means 2 is placed on an original table 3 and exposed onto said photosensitive member by means of an imagewise exposure means 4 which is provided with a light source $\mathbf{4}_1$ consisting for example of a halogen lamp illuminating the original placed on said original table 3, movable mirrors $\mathbf{4}_2$ and $\mathbf{4}_3$ displaced in combination with said light source $\mathbf{4}_1$ to perform scanning of the surface of said original wherein said mirror $\mathbf{4}_2$ being displaced at a velocity twice as large as that of mirror $\mathbf{4}_3$, an optical lens $\mathbf{4}_4$ and fixed mirrors $\mathbf{4}_5$ and $\mathbf{4}_6$.

Further along the periphery of said photosensitive drum and next to said electrostatic latent image forming means there is provided a developing means 5, which can for example be a sleeve-type magnetic brush developing device consisting of a rotary magnetic sleeve provided with magnets fixed therein.

In necessary, it is further possible to apply a suitable bias potential to the sleeve in order to prevent the fog formation.

By such developing means there is formed a developed image on the photosensitive member.

In order to transfer thus obtained developed image there is provided a transfer means 6 comprising a feed roller $\mathbf{6}_1$ for feeding a transfer sheet P from a storage cassette $\mathbf{6}_0$, a timing roller $\mathbf{6}_2$ for controlling the timing of supply of said transfer sheet to the transfer position, a guide member $\mathbf{6}_3$ for guiding said transfer sheet to the transfer position, a corona discharger $6_4$ for applying a transferring corona discharge to the back side of said transfer sheet at the transfer position thereof, and a separating roller $6_5$ provided adjacent to said corona discharger $6_4$ for separating the transfer sheet after the transfer of image.

There is further provided a fixing means 7 for fixing the developed image onto said transfer sheet P after the transfer of said image, said means in the illustration being a heated-roller fixing device with heat sources in the upper and lower rollers. Approximately above the photosensitive drum there is provided a cleaning means 8 for removing the toner particles remaining on said drum after the image transfer, said means in the illustration being an elastic cleaning blade.

Furthermore, along the periphery of said photosensitive drum there are provided an AC corona discharger 9 for eliminating the retentive electrostatic charge remaining on said drum after the removal of remaining toner particles, and a flash exposure light source 10 for simultaneously liberating the charge in the photoconductive layer.

A reproduction of the original light image is thus produced by means of the composition explained in the foregoing.

Figure 2:
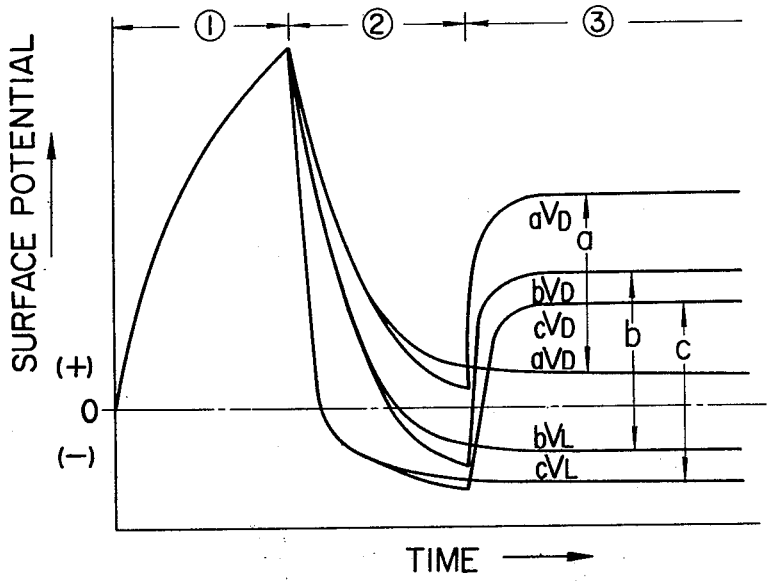
FIG. 2 is a potential curve showing the change of the surface potential of photosensitive member in the apparatus shown in FIG. 1.

FIG. 2 shows the change in the surface potential of the photosensitive member during the course of the electrostatic latent image forming process in the embodiment shown in FIG. 1A, wherein the zones (1), (2) and (3) respectively correspond to the step of primary corona discharge, the step of imagewise exposure and of secondary corona discharge (charge elimination by AC corona) to be conducted approximately simultaneously therewith, and the step of flash exposure. The contrast of the electrostatic latent image can be modified by changing the intensity of said secondary corona discharge (charge elimination by AC corona) in said zone (2).

Figure 3:
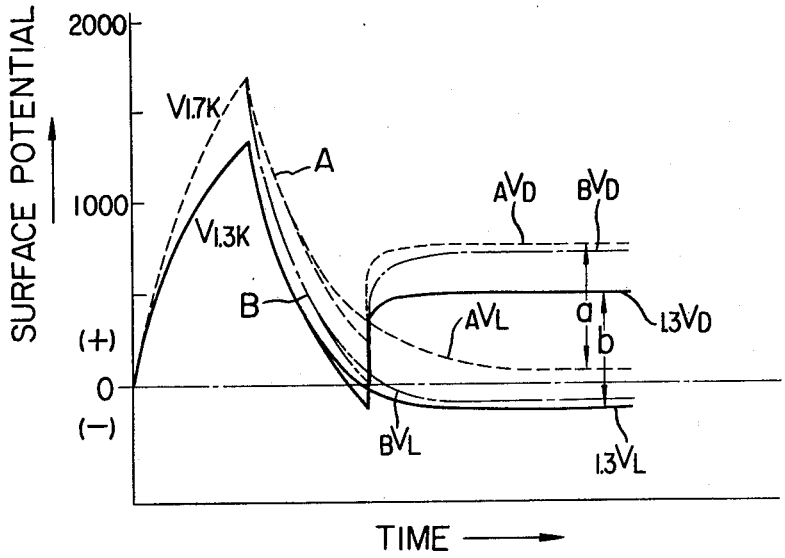
FIG. 3 is a potential chart illustrating the change of surface potential in response to the change in the primary voltage.

Also FIG. 3 shows the behavior of the surface potential of the photosensitive member when the primary charge potential is controlled to 1300 V or 1700 V, wherein the case of 1300 V is represented by full lines while that of 1700 V is represented by broken and chain lines.

Without modification in the AC charge removal by the secondary corona discharge step (broken line A), an increase in the primary charge potential results not only in an elevated potential ${}_AV_D$ in the dark area but also in a positively shifted background potential ${}_AV_L$ from an appropriate background potential ${}_{1.3}V_L$ obtainable at a primary potential of 1300 V, thus inevitably leading to fog formation in the background area.

For this reason it becomes necessary to achieve an appropriate background potential ${}_BV_L$ by suitably regulating the intensity of secondary corona discharge.

Figure 4:
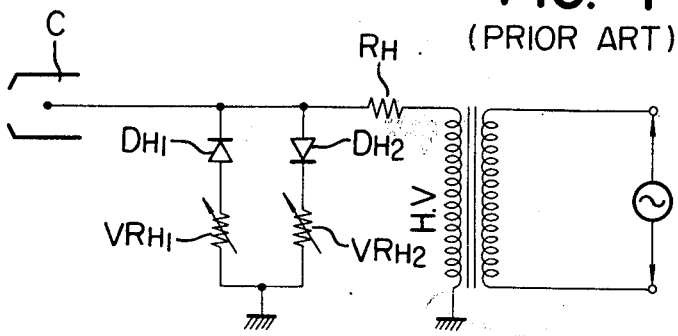
FIG. 4 (PRIOR ART)
FIG. 4 is a circuit diagram of a conventional high-voltage supply means.

Now referring to FIG. 4 showing an example of prior means for distorting the sinusoidal AC wave form, there are provided diodes $D_{H1}$, $D_{H2}$ and variable impedances $VR_{H1}$, $VR_{H2}$ connected to the output of a power source in parallel with the corona discharger for the purpose of controlling the distortion. In such composition said variable impedances $VR_{H1}$ and $VR_{H2}$ are inevitably subjected to a high voltage of several kilovolts, as the discharge wire of said corona discharger C is usually supplied with a high voltage amount to 6–10 kilovolts.

FIGS. 5(A) to 5(D) illustrate the examples of high-voltage power supply adapted for use in the apparatus of the present invention, wherein the transformer is provided, in addition to a primary input coil and a secondary output coil, with an independent tertiary coil of a low voltage provided with a variable impedance of which regulation causes the output wave form thereby obtaining a desired voltage.

Figure 5A:
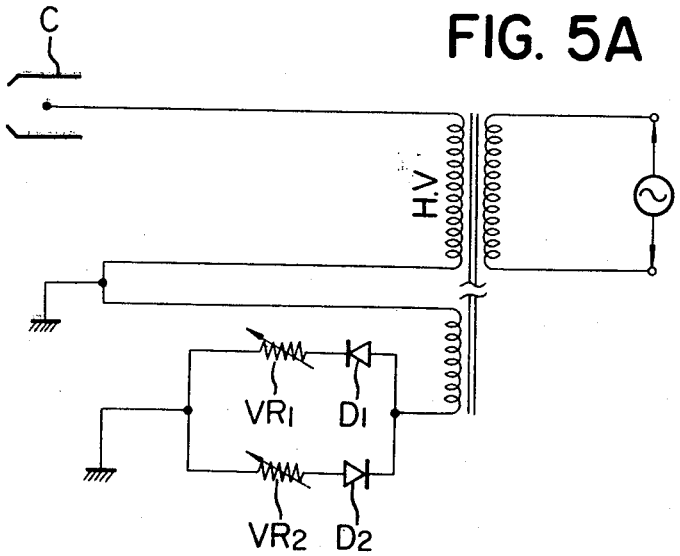
FIGS. 5(A)–(D) are circuit diagrams of high-voltage supply means adapted for use in the apparatus of the present invention.
Figure 5B:
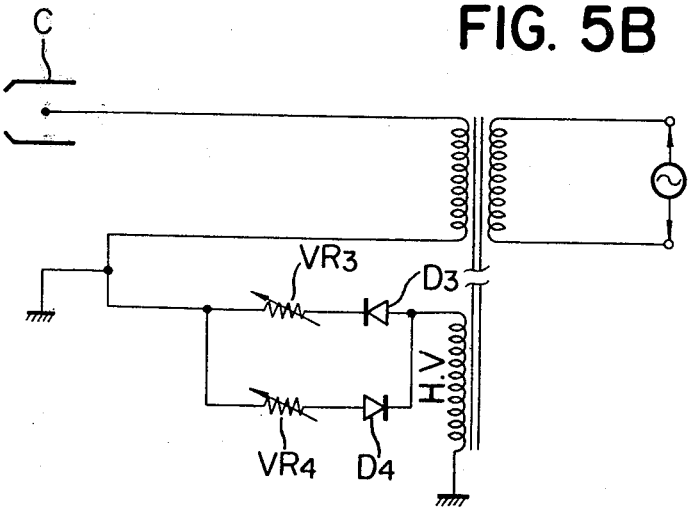
Figure 5C:
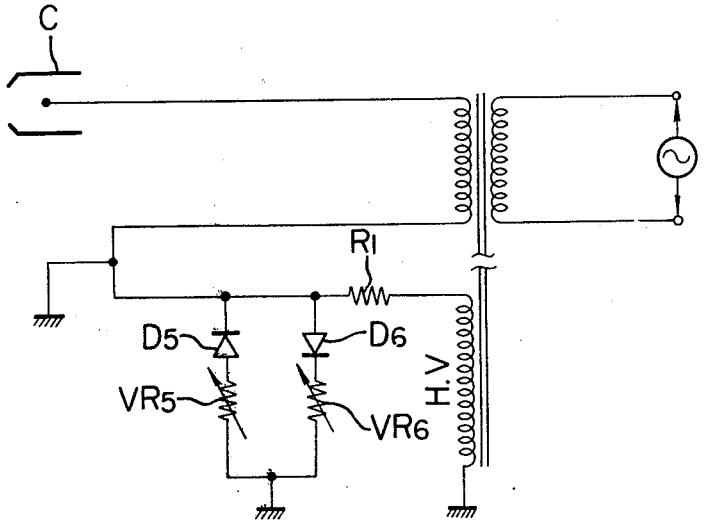

In the circuits of FIGS. 5(A) and 5(B) variable impedances $VR_1$, $VR_2$ or $VR_3$, $VR_4$ connected in series with diodes $D_1$, $D_2$ or $D_3$, $D_4$ are provided on either one of the grounded terminals of the tertiary coil, while in the circuit of FIG. 5(C) variable impedances $VR_5$, $VR_6$ with diodes $D_5$, $D_6$ are connected parallel to said tertiary coil. Such variable impedances connected to the tertiary coil controls the wave form of the corona current, thus causing an appropriate bias in the current supplied to the AC corona discharger.

Figure 5D:
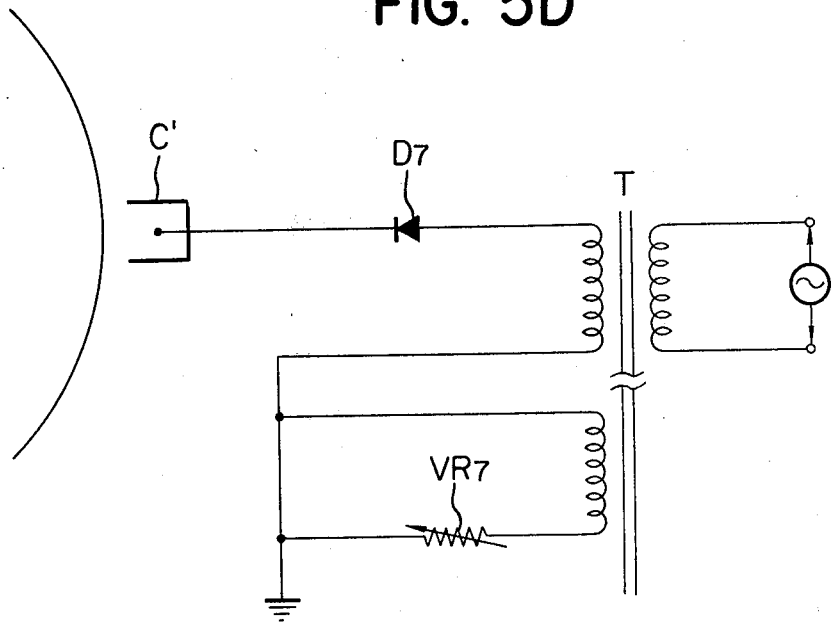

Also FIG. 5(D) shows an example of circuit for regulating the output to the DC corona discharger C′, wherein a diode or rectifier $D_7$ is connected to the output of the secondary coil while a variable impedance $VR_7$ is connected to the tertiary coil.

The above-mentioned high-voltage power supply to be employed in the apparatus of the present invention is based on the characteristics of the transformer to be explained later, and is advantageous in that the output voltage can be suitably selected and the variable impedance can be optimized in response to the desired range of control as the voltage on the tertiary coil can be arbitrarily selected.

Figure 6A:
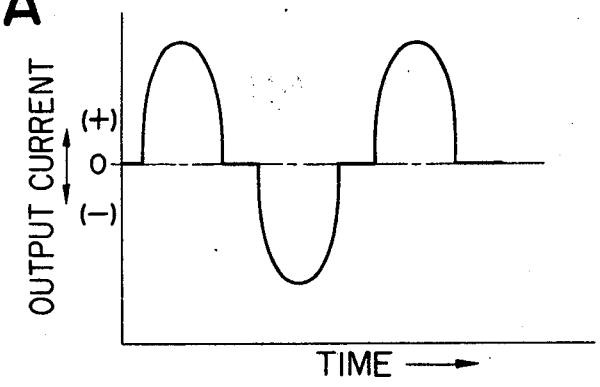
FIGS. 6(A)–(C) are waveform charts showing the biased output current obtainable by the means of the present invention.
Figure 6B:
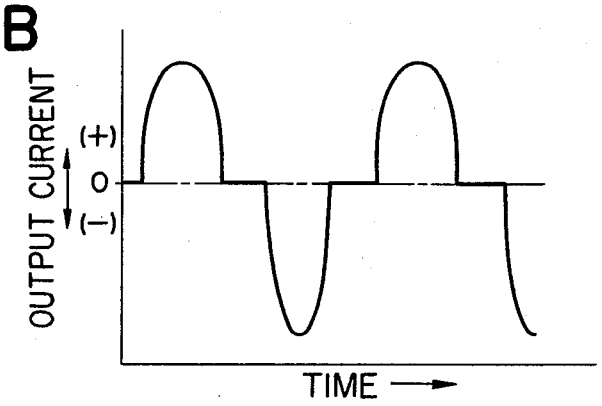
Figure 6C:
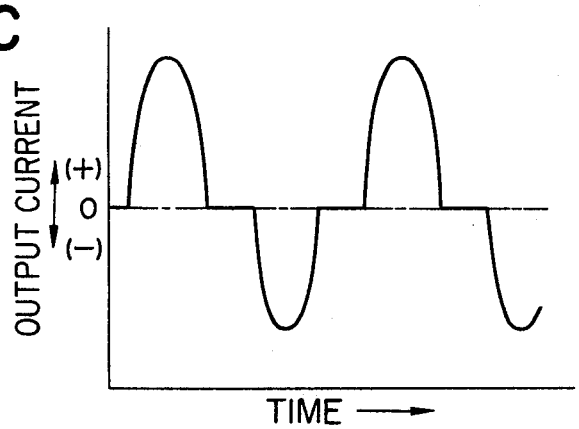

The output wave form obtained by the above-mentioned power supply circuits is shown in FIGS. 6A–C, wherein FIG. 6(A) represents the wave form of corona discharge current when a sinusoidal high voltage is applied, FIG. 6(B) represents the wave form with a negative shift as the result of control of variable impedance, and FIG. 6(C) is the wave form with a output with a desired amount of bias through suitable control of the variable impedance.

Figure 7:
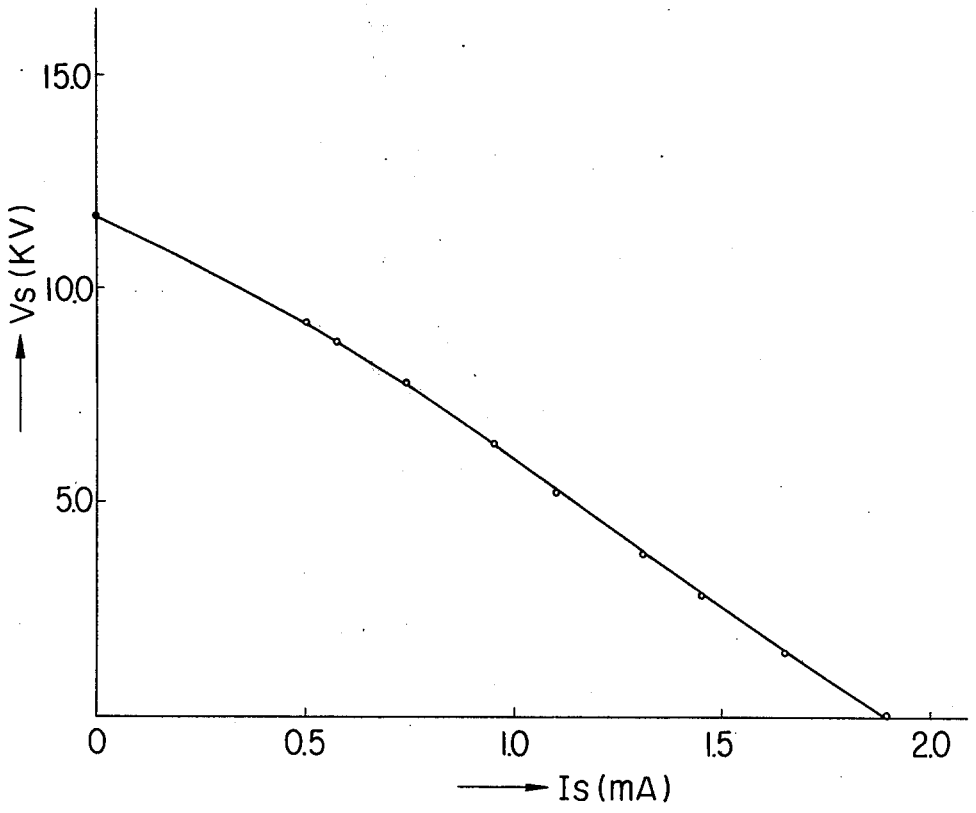
FIG. 7 is a chart showing the characteristics of the high-voltage transformer adapted for use in the apparatus of the present invention.

FIG. 7 shows the drooping characteristics of the high-voltage transformer adapted for use in the high-voltage power supply in the apparatus of the present invention, said transformer being designed to change the output voltage thereof in response to the change in current, and being therefore significantly different from ordinary transformers where the output voltage is maintained approximately constant irrespective of the change in current. The high-voltage transformer employed in the present invention can therefore supply a desired high output voltage without any danger by means of the regulation of the variable impedance connected to the tertiary coil thereof.

Furthermore the power supply of the present invention, being provided with a diode exclusively for each polarity in the tertiary coil as shown in FIGS. 5(A-)–5(C), assures a safe and rapid control of the component of each polarity in the AC output voltage for AC discharge by means of suitably regulating the variable impedance belonging to each polarity.

Figure 8:
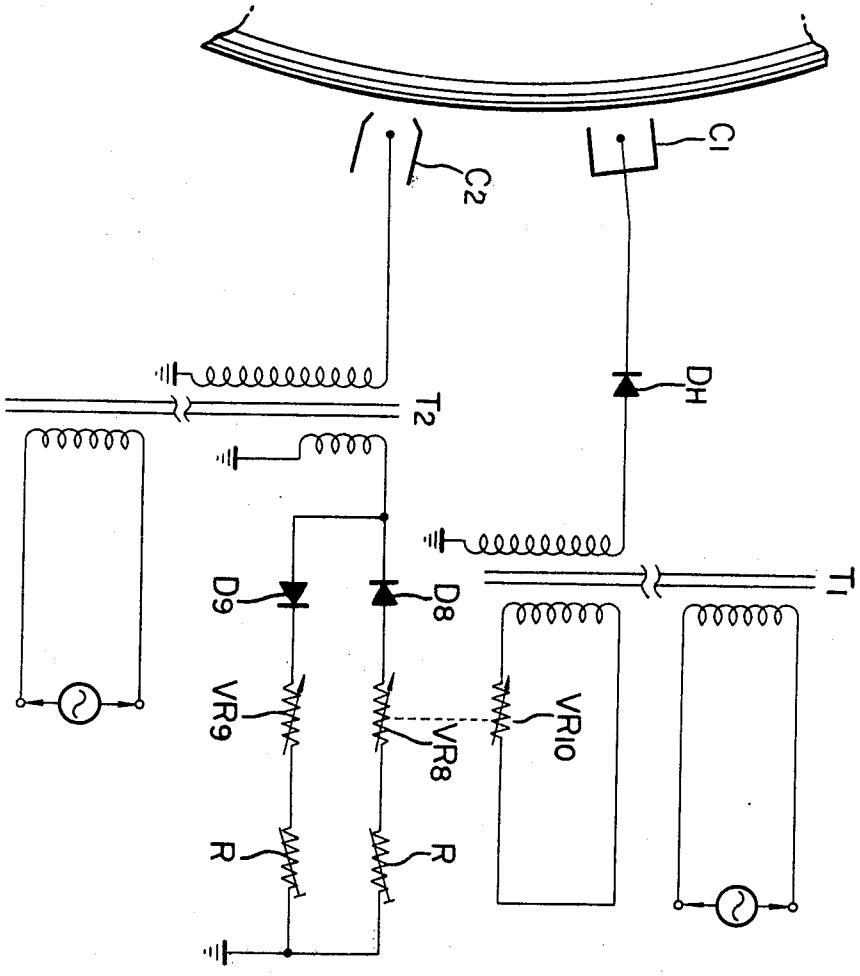
FIG. 8 is a circuit diagram of a different embodiment of the corona discharge means adapted for use in the apparatus of the present invention.

Now there will be given an explanation on an embodiment shown in FIG. 8 wherein a linked control is provided for the primary corona discharge means $C_1$ and the secondary corona discharge means $C_2$. In this embodiment a high-voltage transformer $T_1$ connected to a primary corona discharge means $C_1$ is provided, in addition to a primary input coil and a secondary output coil, with a tertiary coil loaded with a variable resistor $VR_{10}$.

A terminal of the secondary coil is connected, through a diode $D_H$, to the corona wire of said corona discharge means $C_1$.

On the other hand a high-voltage transformer $T_2$ connected to a secondary corona discharge means $C_2$ is provided, in addition to a primary input coil and a secondary output coil, with a tertiary coil connected to parallel circuits one of which consists of a serial connection of a diode $D_8$, a variable resistor $VR_8$ and a semi-fixed resistor $R_2$ while the other of which consists of a serial connection of a diode $D_9$, a variable resistor $VR_9$ and a semi-fixed resistor $R_3$. In the illustrated circuit said variable resistor $VR_8$ is mechanically linked with said variable resistor $VR_{10}$ for the high-voltage transformer $T_1$. In this manner a linked control of the output voltages of high-voltage transformers $T_1$ and $T_2$ allows to obtain an electrostatic latent image of an elevated potential and to simultaneously control the background potential at a value reducing the fog formation.

In the illustrated embodiment the linked control is provided between the variable resistors $VR_8$ and $VR_{10}$, but it will be readily understood that such linked control may instead be established between the variable resistors $VR_9$ and $VR_{10}$, or between $VR_8$ and $VR_9$.

The amount of control of the variable impedances connected to the tertiary coils of above-mentioned high-voltage transformers $T_1$, $T_2$, though depending on the characteristics of said transformers, can be defined as follows in relation to the surface potential of the photosensitive member. Supposing that the change of surface potential caused by the modification in the primary discharge is $\Delta V_0$, the corresponding change in the secondary corona discharge is preferably conducted in such a manner that the change in surface potential after said corona discharge is approximately equal to $\Delta V_0/5$, or $\Delta V_0/3$ if necessary. Such method of linked control is found to provide a satisfactory image reproduction without fog formation.

In a preferred embodiment of the present invention the voltage across the tertiary coil of high-voltage transformer for the secondary corona discharge means is selected as approximately 50 V while the variable impedance is varied within a range from 800 to 300 ohms to obtain a current of 60–160 $\mu$A, consuming a power of 3–8 W and thereby providing a biased output with a positive current of 350–250 $\mu$A and a negative current of 500–600 $\mu$A. The above-mentioned composition realizes an output current control with an elevated safety. In said embodiment it is made possible to maintain the background potential at approximately $-100$ V by means of a biased AC corona with a positive current of 350 $\mu$A and a negative current of 500 $\mu$A for a primary surface potential of 1300 V, and also by means of a biased AC corona with a positive current of 250 $\mu$A and a negative current of 600 $\mu$A for a primary surface potential of 1700 V. Consequently the image obtained after development was entirely free from fog formation.

As detailedly explained in the foregoing embodiment, the apparatus of the present invention allows to satisfactorily control the potentials in the background and dark areas in the electrostatic latent image, thereby enabling satisfactory image reproduction with an elevated contrast and without fog formation.

Also the apparatus of the present invention, wherein the high-voltage supply is controlled by a variable impedance provided in a tertiary coil of the transformer, assures a high level of safety and allows to maintain the image reproduction at a high quality level.

Furthermore the apparatus of the present invention enables a rapid potential control of the electrostatic latent image by means of a linked control of the primary corona discharge means and the secondary corona discharge means.

What we claim is:

1. An electrophotographic apparatus comprising a photosensitive member including an electroconductive layer, a photoconductive layer and an insulating layer; a variably controlled primary corona discharge means for applying a charge of a predetermined potential onto the surface of said photosensitive member; a secondary corona discharge means for applying a corona discharge containing a component of opposite polarity to that of said primary corona discharge; an imagewise exposure means for exposing said photosensitive member to a light image substantially simultaneously with the corona discharge by said secondary corona discharge means; high-voltage supply means including high voltage transformers for supplying predetermined high-voltages to said primary and secondary corona discharge means, at least one of said transformers having the drooping characteristic, and being provided with a primary input coil, a secondary high-voltage output coil and a tertiary coil associated with a variable load impedance; and a corona discharge link control means for a linked control of the amounts of corona discharge from said primary and secondary corona discharge means to provide an electrostatic latent image having a predetermined potential at the light areas of the image.

2. An electrophotographic apparatus according to claim 1 wherein the output of said high-voltage transformer having the drooping characteristic is supplied to said secondary corona discharge means.

3. An electrophotographic apparatus according to claim 1 wherein the output of said high-voltage transformer having the drooping characteristic is supplied to said primary corona discharge means.

4. An electrophotographic apparatus according to claim 1 wherein said high-voltage supply means comprises at least two high-voltage transformers each provided at least with a primary input coil, a secondary high-voltage output coil and a tertiary coil associated with a variable load impedance, the output of one of said transformers being supplied to said primary corona discharge means while the output of the other is supplied to said secondary corona discharge means.

5. An electrophotographic apparatus according to claim 4 wherein said corona discharge link control means coordinates said variable load impedances in two high-voltage transformers respectively supplying outputs to said primary and secondary corona discharge means.

6. An electrophotographic apparatus comprising a photosensitive member supported in such a manner to allow cyclic movement thereof and including an electroconductive layer, a photoconductive layer and an insulating layer; a variably controlled primary corona discharge means for applying a static charge of a predetermined potential onto the surface of said photosensitive member; a secondary corona discharge means for applying a corona discharge containing a component of opposite polarity to that of said primary corona discharge; an imagewise exposure means for exposing said photosensitive member to a light image substantially simultaneously with the corona discharge by said secondary corona discharge means; high-voltage supply means including high voltage transformers for supplying predetermined high voltages to said primary and secondary corona discharge means, at least one of said transformers having the drooping characteristic, and being provided with a primary input coil, a secondary high-voltage output coil and a tertiary coil associated with a variable load impedance; a corona discharge link control means for a linked control of the amounts of corona discharge from said primary and secondary corona discharge means to provide an electrostatic latent image having a predetermined potential at the light areas of the image; a developing means, a transfer means; and a cleaning means.

7. An electrophotographic apparatus according to claim 6 wherein the output of said high-voltage transformer having the drooping characteristic is supplied to said secondary corona discharge means.

8. An electrophotographic apparatus according to claim 6 wherein the output of said high-voltage transformer having the drooping characteristic is supplied to said primary corona discharge means.

9. An electrophotographic apparatus according to claim 6 wherein said high voltage supply means comprises at least two high-voltage transformers each provided at least with a primary input coil, a secondary high-voltage output coil and a tertiary coil associated with a variable load impedance, the output of one of said transformers being supplied to said primary corona discharge means while the output of the other is supplied to said secondary corona discharge means.

10. An electrophotographic apparatus according to claim 9 wherein said corona discharge link control means coordinates said variable load impedances of two high-voltage transformers respectively supplying outputs to said primary and secondary corona discharge means.

* * * * *